US009360784B2

(12) United States Patent
Fujibayashi et al.

(10) Patent No.: US 9,360,784 B2
(45) Date of Patent: Jun. 7, 2016

(54) MAGENTA TONER FOR DEVELOPING ELECTROSTATIC LATENT IMAGES

(71) Applicant: Samsung Electronics Co., Ltd., Suwon-si, Gyeonggi-do (KR)

(72) Inventors: Fusaki Fujibayashi, Kanagawa (JP); Takuya Kitabatake, Kanagawa (JP); Takatoshi Seto, Kanagawa (JP)

(73) Assignee: SAMSUNG ELECTRONICS CO., LTD. (KR)

( * ) Notice: Subject to any disclaimer, the term of this patent is extended or adjusted under 35 U.S.C. 154(b) by 0 days.

(21) Appl. No.: 14/593,789

(22) Filed: Jan. 9, 2015

(65) Prior Publication Data

US 2015/0192873 A1 Jul. 9, 2015

(30) Foreign Application Priority Data

Jan. 9, 2014 (JP) ..... 2014-002484

(51) Int. Cl.
*G03G 9/09* (2006.01)

(52) U.S. Cl.
CPC ..... *G03G 9/0902* (2013.01); *G03G 9/091* (2013.01); *G03G 9/092* (2013.01); *G03G 9/0926* (2013.01)

(58) Field of Classification Search
CPC .. G03G 9/0902; G03G 9/0926; G03G 9/0928
See application file for complete search history.

(56) References Cited

U.S. PATENT DOCUMENTS

| | | | |
|---|---|---|---|
| 6,168,892 | B1 | 1/2001 | Ohara et al. |
| 6,706,457 | B2 | 3/2004 | Koumura |
| 2003/0054277 | A1 | 3/2003 | Fujikura |

FOREIGN PATENT DOCUMENTS

| | | | | |
|---|---|---|---|---|
| EP | 0965890 | A1 | 12/1999 | |
| EP | 1 983 378 | * | 10/2008 | ..... G03G 9/09 |
| JP | 594037 | | 4/1993 | |
| JP | 5100471 | | 4/1993 | |
| JP | 5119519 | | 5/1993 | |
| JP | 5166884 | | 7/1993 | |
| JP | 9255882 | | 9/1997 | |
| JP | 11194530 | | 7/1999 | |
| JP | 11202543 | | 7/1999 | |
| JP | 2000-004373 | | 1/2000 | |
| JP | 2000-181170 | | 6/2000 | |
| JP | 20001811170 | | 6/2000 | |
| JP | 2002-148851 | A | 5/2002 | |
| JP | 2002003835 | | 9/2002 | |
| JP | 2004144854 | | 5/2004 | |
| JP | 2004210566 | | 7/2004 | |
| JP | 2004264445 | | 9/2004 | |
| JP | 2005148448 | | 6/2005 | |
| JP | 200717719 | | 1/2007 | |
| JP | 3964617 | | 6/2007 | |
| JP | 2007304401 | | 11/2007 | |

(Continued)

OTHER PUBLICATIONS

Hongli Liu et al. "Luminescent properties of Eu3+ and Sm3+ activated M2SiO4 (M = Ba, Sr and Ca) red-emitting phosphors for WLEDs" Journal of Luminescence 132 (2012) 2908-2912.

*Primary Examiner* — Hoa V Le

(74) *Attorney, Agent, or Firm* — Cantor Colburn LLP

(57) ABSTRACT

A magenta toner for developing electrostatic latent images, wherein the magenta toner includes a magenta toner particle having a polymer binder and a colorant, wherein the colorant includes a magenta pigment or dye and a visible light-excitable nitride fluorescent substance.

7 Claims, 1 Drawing Sheet

(56) References Cited

FOREIGN PATENT DOCUMENTS

| | | |
|---|---|---|
| JP | 2008145750 | 6/2008 |
| JP | 2008262171 | 10/2008 |
| JP | 2008287239 | 11/2008 |
| JP | 200969259 | 4/2009 |
| JP | 201049204 | 3/2010 |
| JP | 201072643 | 4/2010 |
| JP | 2010256523 | 11/2010 |
| JP | 2011128414 | 6/2011 |
| JP | 2011242431 | 12/2011 |
| JP | 2012215810 | 11/2012 |
| JP | 2013101336 | 5/2013 |

* cited by examiner

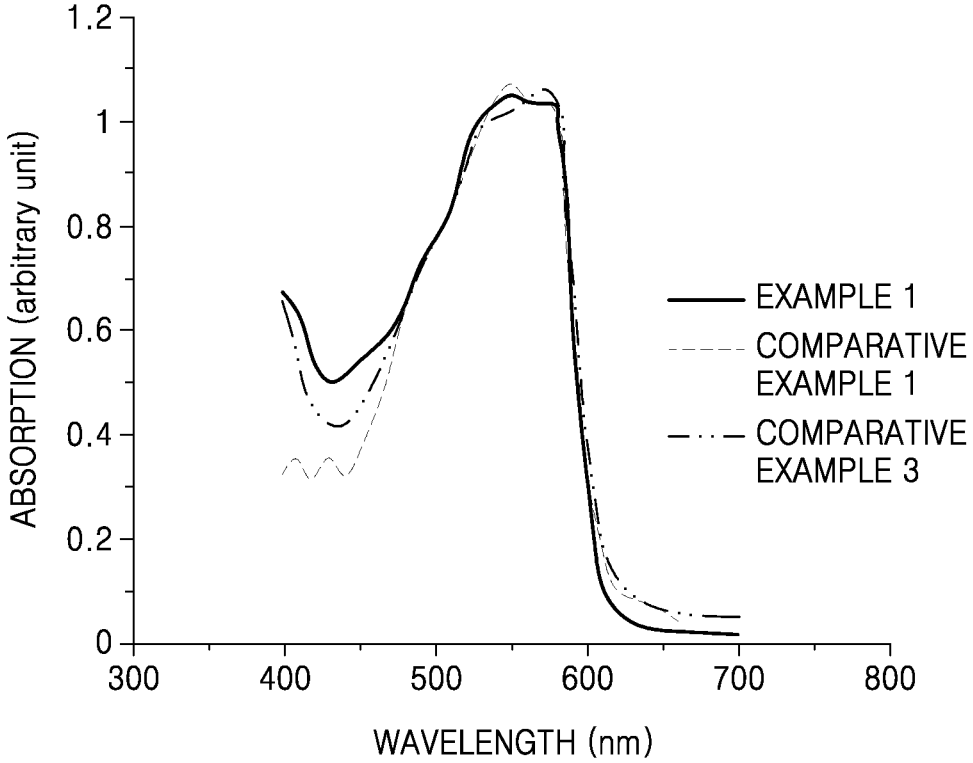
1.2
1
0.8
0.6
0.4
0.2
0
ABSORPTION (arbitrary unit)
300
400
500
600
700
800
WAVELENGTH (nm)
EXAMPLE 1
COMPARATIVE EXAMPLE 1
COMPARATIVE EXAMPLE 3

MAGENTA TONER FOR DEVELOPING ELECTROSTATIC LATENT IMAGES

CROSS-REFERENCE TO RELATED APPLICATION

This application claims priority to Japanese Patent Application No. 2014-002484, filed on Jan. 9, 2014, in the Japan Patent Office, and all the benefits accruing therefrom under 35 U.S.C. §119, the content of which is incorporated herein in its entirety by reference.

BACKGROUND

1. Field

The present disclosure is directed to a magenta toner for developing electrostatic latent images.

2. Description of the Related Art

Recently, a demand for high-quality printed color images has been increasing. In a typical digital color copier or printer, an original color image is divided by color via blue, green, and red filters, and a latent image corresponding to the original color image is developed by using toner of yellow, magenta, and cyan, which, respectively, are complementary colors of blue, green, and red, and black toner. Accordingly, a colorant in toner largely affects an image quality (for example, tone, transparency, and color reproduction). Among various color toners, magenta toner plays an important role in reproducing a tone of the skin. In addition, since the skin tone of a human subject is a half tone, excellent developability is desired for magenta toner. Given this need, as a conventional colorant for magenta toner, a quinacridone colorant, a thioindigo colorant, a xanthene colorant, a monoazo colorant, a perylene colorant, and a diketo-pyrrolo-pyrrole (DPP) colorant are well known.

In general, when a pigment is used as a magenta colorant, high light-fastness may be obtained. But, its tone and transparency may not be sufficient. For example, to improve these characteristics, JP 1997-255882 A discloses that a pigment may be finely-dispersed in various media. However, it is difficult to allow a pigment included in a toner prepared by the conventional toner preparation procedure to have a sufficiently fine particle diameter. Also, it is difficult to homogeneously disperse fine pigment particles in a toner.

As a method to enlarge a color gamut, for example, a full-color image forming method has been suggested. The full-color image forming method utilizes a 5 or more color toner set including orange toner or red toner, in addition to yellow toner, magenta toner, cyan toner and black toner. In the method, colors in the 360 degree range of the munsell color circle-chart are reproduced by additionally using orange toner or red toner in addition to a yellow toner, a magenta toner, and a cyan toner, thus, enlarging a color reproduction region. For example, JP 2007-304401 A discloses that an orange toner using an orange colorant, such as C. I. pigment orange 1, 11 or the like, is used to enlarge a color reproduction region from a red region to an orange region. Also, JP 2011-242431 A discloses that red toner using a red colorant, such as C. I. vat red 41 is used to enlarge a color reproduction region from a red region to an orange region. These methods, however, require a complicated developing system, and thus require a complicated control, thereby, making it difficult to ensure a high quality image to be obtained.

JP 2000-181170 A discloses a toner in which a fluorescent colorant is added to a colorant to obtain improved brightness, enlarged color reproduction region, and improved color tone. However, since a wavelength region outside a main wavelength region of an absorption spectrum has an absorption area of 98% or less, it is difficult to enlarge a color reproduction region while the color quality is maintained. Also, the high demand for high-quality images has led to the high demand for more finely divided toner particles having a smaller particle diameter. However, when known oxide inorganic fluorescent substances are more finely divided for the addition into the more finely divided toner particles, fluorescent characteristics of the inorganic fluorescent substance may deteriorate. Accordingly, improvement in color reproduction effects is insufficient.

Thus, as described above, to improve the quality of a printed color image, to obtain excellent transparency of a printed color image, or to obtain a printed color image that is closer to an original image thereof, there is an increasing need to develop magenta toner having improved tone, chroma, and electrophotographic properties.

SUMMARY

To improve the quality of a printed color image, to obtain excellent transparency of a printed color image, or to obtain a printed color image that is closer to an original image thereof, the present disclosure provides a magenta toner having improved tone, chroma, and electrophotographic properties.

Additional aspects will be set forth in part in the description which follows and, in part, will be apparent from the description, or may be learned by practice of the presented embodiments.

An embodiment of a magenta toner for developing electrostatic latent images according to an aspect of the present disclosure includes a magenta toner particle having a polymer binder and a colorant, wherein the colorant includes a magenta pigment or dye and a visible light-excitable nitride fluorescent substance.

BRIEF DESCRIPTION OF THE DRAWINGS

These and/or other aspects will become apparent and more readily appreciated from the following description of the embodiments, taken in conjunction with FIG. 1 which is graph of absorption (arbitrary unit, a. u.) versus wavelength (nanometers, nm) showing a visible-light absorption spectrum of magenta toner for developing electrostatic latent images prepared according to Example 1, and a visible-light absorption spectrum of magenta toner for developing electrostatic latent images prepared according to Comparative Examples 1 and 3.

DETAILED DESCRIPTION

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. The term "or" means "and/or." Expressions such as "at least one of" when preceding a list of elements, modify the entire list of elements and do not modify the individual elements of the list.

It will be understood that when an element is referred to as being "on" another element, it can be directly in contact with the other element or intervening elements may be present therebetween. In contrast, when an element is referred to as being "directly on" another element, there are no intervening elements present.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present embodiments.

The terminology used herein is for the purpose of describing particular embodiments only and is not intended to be limiting. As used herein, the singular forms "a," "an," and "the" are intended to include the plural forms as well, unless the context clearly indicates otherwise.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, by referring to the attached drawings, embodiments of the present disclosure will be explained in detail. However, the embodiments are presented herein only for ease of understanding the principle of the present disclosure, and do not limit the scope of the present disclosure. Also, one of ordinary skill in the art may appropriately modify at least a part of the embodiments, and the resultant embodiments are also included in the scope of the present disclosure.

An embodiment of a magenta toner for developing electrostatic latent images according to an aspect of the present disclosure includes a magenta toner particle including a polymer binder and a colorant, wherein the colorant includes a magenta pigment or dye and a visible light-excitable nitride fluorescent substance.

In order for an electrophotographically printed color image to have a higher quality, a toner is required to have a smaller particle diameter. An emulsion coagulation method or a suspension polymerization method may be used to obtain micro-fine toner particles having a smaller particle diameter, such as, about 6 micrometers (μm). To homogeneously disperse a colorant within such a micro-fine toner particle, it is desired that the dispersed colorant particles have an average particle diameter of about 50 nanometers (nm) to about 500 nm. However, in general, fine oxide fluorescent substance particles having such a small particle diameter may not retain their intrinsic fluorescent characteristics. Accordingly, even when fine oxide fluorescent substance particles are added to a colorant, desired improvement effects may not be obtained. However, the visible light-excitable nitride fluorescent substance used in embodiments of the present disclosure may retain its intrinsic fluorescent characteristics, even when the particle diameter is small, such as, for example, about 50 nm to about 500 nm.

An average particle diameter of the dispersed particles of the visible light-excitable nitride fluorescent substance may be, for example, in a range of about 50 nm to about 500 nm. When the average particle diameter is smaller than about 50 nm, fluorescent characteristics of the dispersed particles of the visible light-excitable nitride fluorescent substance may substantially decrease. When the average particle diameter is greater than about 500 nm, it may be difficult to homogeneously disperse the colorant within the toner particle.

An amount of the visible light-excitable nitride fluorescent substance in the colorant may be, for example, in a range of about 5 percent by weight (wt %) to about 75 wt % based on 100 wt % of a total weight of the colorant. When the amount of the visible light-excitable nitride fluorescent substance is smaller than about 5 wt %, fluorescent characteristics of the visible light-excitable nitride fluorescent substance may decrease. When the amount of the visible light-excitable nitride fluorescent substance is greater than about 75 wt %, transparency of the colorant may be dominating and thus, the base color of the colorant may appear transparent.

A host crystal for the visible light-excitable nitride fluorescent substance may include, for example, at least one selected from $MAlSiN_3$, $M_2Si_5N_8$, $M_3SiO_5$, MS, $MGa_2S_4$, and $MSi_2N_2O_2$, where M represents at least one selected from magnesium (Mg), calcium (Ca), strontium (Sr), and barium (Ba). An activator for the visible light-excitable nitride fluorescent substance may include, for example, at least one selected from europium (Eu), chromium (Cr), manganese (Mn), iron (Fe), bismuth (Bi), cerium (Ce), praseodymium (Pr), neodymium (Nd), samarium (Sm), terbium (Tb), dysprosium (Dy), holmium (Ho), erbium (Er), thulium (Tm), and ytterbium (Yb).

Examples of the visible light-excitable nitride fluorescent substance are $CaAlSiN_3$:Eu, $SrAlSiN_3$:Eu, $(Ca_{1-a}Sr_a)AlSiN_3$:Eu, $CaAlSiN_3$:Ce, $SrAlSiN_3$:Ce, $(Ca_{1-a}Sr_a)AlSiN_3$:Ce, $Ca_2Si_5N_8$:Eu, $Sr_2Si_5N_8$:Eu, $Ba_2Si_5N_8$:Eu, $(Ca_{1-a}Sr_a)_2Si_5N_8$:Eu, $Ca_2Si_5N_8$:Ce, $Sr_2Si_5N_8$:Ce, $Ba_2Si_5N_8$:Ce, $(Ca_{1-a}Sr_a)_2Si_5N_8$:Ce, $Ba_3SiO_5$:Eu, $(Sr_{1-a}Ba_a)_3SiO_5$Eu, $Sr_3SiO_5$:Eu, CaS:Eu, SrS:Eu, BaS:Eu, CaS:Ce, SrS:Ce, BaS:Ce, $CaGa_2S_4$:Eu, $SrGa_2S_4$:Eu, $BaGa_2S_4$:Eu, $CaGa_2S_4$:Ce, $SrGa_2S_4$:Ce, $BaGa_2S_4$:Ce, $CaSi_2N_2O_2$:Eu, $SrSi_2N_2O_2$:Eu, $BaSi_2N_2O_2$:Eu, $CaSi_2N_2O_2$:Ce, $SrSi_2N_2O_2$:Ce, $BaSi_2N_2O_2$:Ce, $(Ba, Sr, Ca)_2SiO_4$:Eu, $Ba_3Si_6O_9N_4$:Eu, and any combination thereof, wherein a satisfies the condition of $0 \leq a \leq 1$.

A magenta toner for developing electrostatic latent images according to an embodiment includes a polymer binder. The polymer binder is not particularly limited. The polymer binder may include, for example, a styrene-ester acrylate copolymer, a styrene-ester acrylate-(meth)acrylic acid copolymer, a polyester, or a combination thereof. The polyester may be obtained by, for example, condensation-polymerization of a polybasic carboxylic acid and a polyhydric alcohol. An acid value of the polymer binder is not particularly limited. The acid value of the polymer binder may be in a range of about 5 milligrams of potassium hydroxide (KOH) per gram (mgKOH/g) to about 20 mgKOH/g. When the acid value of the polymer binder is within this range, the stability of charging of the toner in a humid condition may be further improved.

A magenta toner for developing electrostatic latent images according to an embodiment includes a magenta pigment or dye.

The magenta pigment may be, for example, a monoazo pigment. The monoazo pigment may be, for example, represented by Formula 1 below:

Formula 1

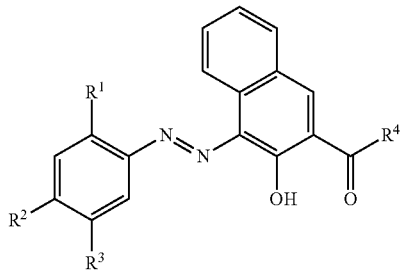

$R^1$ to $R^3$ in Formula 1 each represent a substituent selected from a hydrogen atom, an alkyl group, an alkoxy group, a halogen atom, a nitro group (—$NO_2$), an anilide group (Ar—NH—, wherein Ar is an aryl group), and a sulfamoyl group. $R^4$ represents a substituent selected from substituents listed below: —OH, —$NH_2$,

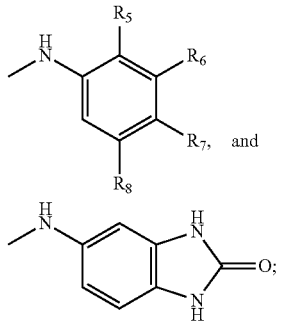

wherein, $R^5$ to $R^8$ each represent a substituent selected from —H, —Cl, —$CH_3$, —$OCH_3$, —$OC_2H_5$, —$NO_2$, and —NH-$COCH_3$.

Examples of the monoazo magenta pigment include C.I. pigment red 5, C.I. pigment red 31, C.I. pigment red 146, C.I. pigment red 147, C.I. pigment red 150, C.I. pigment red 184, C.I. pigment red 269, and any combination thereof. These monoazo magenta pigments may have excellent light fastness and color hue.

Another example of the magenta pigment is a quinacridone pigment. The quinacridone pigment may be, for example, represented by Formula 2. The quinacridone pigment may be, for example, a unsubstituted quinacridone pigment in which a quinacridone backbone does not have a substituent; a substituted quinacridone pigment in which a quinacridone backbone has a substituent; a solid solution quinacridone pigment including a combination of quinacridone compounds substituted with different substituents; or a combination thereof. Examples of the quinacridone pigment include C.I. pigment violet 19 (unsubstituted quinacridone), C.I. pigment red 122 (2,9-dimethyl quinacridone), C.I. pigment red 202 (2,9-dichloro quinacridone), and C.I. pigment red 209 (3,10-dichloro quinacridone). These quinacridone pigments may be used alone or in combination thereof.

Formula 2

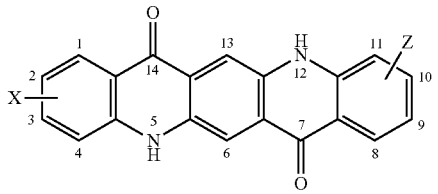

X and Z in Formula 2 each independently represent a substituent, such as a hydrogen atom, an alkyl group, or a halogen group. Numeric values of Formula 2 indicate location of a substituent.

A magenta toner for developing electrostatic latent images according to an embodiment may further include a release agent. Examples of the release agent include a hydrocarbon wax, such as a polyethylene wax, a polypropylene wax, a polybutene wax, or a paraffin wax; silicones that exhibit a softening point under heating; fatty acid amides, such as oleic acid amide, erucic acid amide, ricinoleic acid amide, or stearic acid amide; and a plant wax, such as a carnauba wax, a rice wax, a candelilla wax, tallow, or jojoba oil.

Substituents in the formulae above may be defined as follows.

As used herein, the term "alkyl" refers to a completely saturated, branched or unbranched (or a straight or linear)

hydrocarbon having the specified number of carbon atoms. Non-limiting examples of the "alkyl" group include methyl, ethyl, n-propyl, isopropyl, n-butyl, isobutyl, sec-butyl, t-butyl, isopentyl, neopentyl, iso-amyl, n-hexyl, 3-methylhexyl, 2,2-dimethylpentyl, 2,3-dimethylpentyl, and n-heptyl.

At least one hydrogen atom of the alkyl group may be substituted with a halogen atom, a C1-C20 alkyl group substituted with a halogen atom (for example, —$CCF_3$, —$CHCF_2$, —$CH_2F$, —$CCl_3$, and the like), a C1-C20 alkoxy group, a C2-C20 alkoxyalkyl group, a hydroxyl group (—OH), a nitro group (—$NO_2$), a cyano group (—CN), an amino group (—NRR', wherein R and R' are each independently hydrogen or a C1-C10 alkyl group), an amido group (—C(=O)NRR', wherein R and R' are independently hydrogen or a C1-C10 alkyl group), an amidino group (—C(=NH)NRR' wherein R and R' are independently hydrogen or a C1-C10 alkyl group), a hydrazine group (—NHNRR', wherein R and R' are independently hydrogen or a $C_1$-$C_{10}$ alkyl group), a hydrazone group (—CR=NHNR'R", wherein R, R' and R" are independently hydrogen or a C1-C10 alkyl group), a carboxyl group (—$CO_2H$) or a salt thereof, a sulfonyl group, a sulfamoyl group, a sulfonic acid group (—$SO_3H$) or a salt thereof, a phosphoric acid (—P(=O)$(OH)_2$) or a salt thereof, a C1-C20 alkyl group, a C2-C20 alkenyl group, a C2-C20 alkynyl group, a C1-C20 heteroalkyl group, a C6-C20 aryl group, a C6-C20 arylalkyl group, a C6-C20 heteroaryl group, a C7-C20 heteroarylalkyl group, a C6-C20 heteroaryloxy group, a C6-C20 heteroaryloxyalkyl group, or a C6-C20 heteroarylalkyl group.

As used herein, the term "halogen atom" refers to fluorine, bromine, chloride, iodine, and the like.

As used herein, the term "alkoxy" refers to "alkyl-O-", wherein the alkyl is the same as described above, and which has the specified number of carbon atoms. Non-limiting examples of the alkoxy group include methoxy, ethoxy, n-propoxy, 2-propoxy, n-butoxy, iso-butoxy, t-butoxy, pentyloxy, hexyloxy, cyclopropoxy, and cyclohexyloxy. At least one hydrogen atom of the alkoxy group may be substituted with substituents that are the same as those recited above in conjunction with the alkyl group.

As used herein, the term "aryl", which is used alone or in combination, refers to an aromatic hydrocarbon containing at least one ring and having the specified number of carbon atoms. The term "aryl" may be construed as including a group with an aromatic ring fused to at least one cycloalkyl ring. Non-limiting examples of the "aryl" group include phenyl, naphthyl, and tetrahydronaphthyl. At least one hydrogen atom of the "aryl" group may be substituted with substituents that are the same as those recited above in conjunction with the alkyl group.

As used herein, the term "sulfamoyl" group indicates $H_2NS(O_2)$—, alkyl-$NHS(O_2)$—, $(alkyl)_2NS(O_2)$-aryl-$NHS(O_2)$—, alkyl-(aryl)-$NS(O_2)$—, $(aryl)_2NS(O)_2$, heteroaryl-$NHS(O_2)$—, (aryl-alkyl)-$NHS(O_2)$—, or (heteroaryl-alkyl)-$NHS(O_2)$—.

Hereinafter, one or more embodiments will be described in more detail with reference to the following examples. However, these examples are for illustrative purposes only and are not intended to limit the scope of the present disclosure.

EXAMPLE

1-1. Preparation of Visible Light-Excitable Nitride Fluorescent Substance (A-1)

As raw material powder, the following materials were used: silicon nitride powder having an average particle diameter of 0.5 μm and α-type content of 92 wt %; aluminum nitride powder having a specific surface area of 3.3 square meters per gram ($m^2/g$); calcium nitride powder; and europium nitride synthesized by nitrogenation of europium metal in ammonia.

To obtain a compound represented by formula $Eu_{0.008}Ca_{0.992}AlSiN_3$, the silicon nitride powder, the aluminum nitride powder, the calcium nitride powder, and the europium nitride powder were weighed in amounts of 33.8578 wt %, 29.6814 wt %, 35.4993 wt %, and 0.96147 wt %, respectively, and mixed by using an agate pestle and mortar for 30 minutes. The resultant mixed powder was then allowed to fall freely via a 500 μm sieves into a crucible made of boron nitride, thereby filling the crucible with the mixed powder. A volumetric density of the mixed powder was about 25%. The weighing, mixing, and molding of powder were all performed in a glove box under a nitrogen atmosphere with 1 parts per million (ppm) or less of humidity and 1 ppm or less of oxygen present.

The mixed powder in the boron nitride crucible was transferred into a graphite resistance heating type electric furnace. A calcining process was performed on the mixed powder as follows: a calcining atmosphere was changed into a vacuum condition by using a diffusion pump, and the mixed powder was heated from room temperature to 800° C. at a heating rate of 500° C. per hour. Subsequently, at a temperature of 800° C., 99.999 percent by volume (vol %) nitrogen was introduced thereto to adjust the pressure to 1 megaPascal (MPa). The mixed powder was then heated up to a temperature of 1,800° C. at a heating rate of 500° C. per hour, and maintained at a temperature of 1800° C. for 2 hours.

A crystalline phase formed in the powder synthesized as above was analyzed by powder X-ray diffraction. It was confirmed that $CaAlSiN_3$ crystal was formed. Fluorescent characteristics of the obtained fluorescent substance were measured by using a fluorescence spectrophotometer (F-7000 of Hitachi High-Technologies Corporation). The obtained fluorescent substance had an exciting-light peak wavelength of 465 nm, and an emission-light peak wavelength of 652 nm (red light). Accordingly, it was confirmed that the obtained fluorescent substance was a visible light-excitable nitride fluorescent substance.

The visible light-excitable nitride fluorescent substance was coarsely crushed, and then milled by using an agate pestle and mortar. The milled particles were allowed to pass through a 30 μm sieves, thereby obtaining visible light-excitable nitride fluorescent substance (A-1) having an average particle diameter of 12 μm.

1-2. Preparation of Visible Light-Excitable Nitride Fluorescent Substance (A-2)

The visible light-excitable nitride fluorescent substance (A-1) was milled with a fine crusher (LMZ015, Ashizawa Finetech Ltd., Japan) to obtain a visible light-excitable nitride fluorescent substance (A-2) in the form of fine powder having an average particle diameter of 305 nm. Fluorescent characteristics of the fluorescent substance (A-2) were measured by using a fluorescence spectrophotometer (F-7000, Hitachi High-Technologies Corporation, Japan). It was confirmed that the fluorescent substance (A-2) had an exciting-light peak wavelength of 445 nm and an emission-light peak wavelength of 635 nm (red light).

1-3. Preparation of Visible Light-Excitable Nitride Fluorescent Substance (A-3)

To synthesize a compound represented by formula $Eu_{0.04}Sr_{1.96}Si_5N_8$, silicon nitride powder having an average particle diameter of 0.5 μm, an oxygen content of 0.93 wt %, and an α-type content of 92 wt %, strontium nitride powder, and europium nitride powder were weighed in amounts of 54.34 wt %, 45.08 wt % and 0.58 wt %, respectively. These powders were subsequently mixed, dried, and calcined in the same manner as in the Preparation Example 1-1. The obtained calcination product was coarsely crushed, and then manually milled with a mortar made of a silicon nitride sintered product. The milled calcination product was then allowed to pass through a 30 μm sieves. A particle diameter distribution of the obtained powder was measured, and it was confirmed that an average particle diameter thereof was found to be 10 μm.

A crystalline phase of the synthesized powder was analyzed by powder X-ray diffraction. It was confirmed that a $Sr_2Si_5N_8$ crystal was formed. Fluorescent characteristics of the obtained fluorescent substance were measured by using a fluorescence spectrophotometer (F-7000, Hitachi High-Technologies Corporation, Japan). It was confirmed that the obtained fluorescent substance had an exciting-light peak wavelength of 450 nm, and an emission-light peak wavelength of 640 nm (red light). The synthesized compound was a visible light-excitable nitride fluorescent substance (A-3).

1-4. Preparation of Visible Light-Excitable Nitride Fluorescent Substance (A-4)

The visible light-excitable nitride fluorescent substance (A-3) was milled by using a fine crusher (Japan, Ashizawa Finetech Ltd., LMZ015) to obtain a visible light-excitable nitride fluorescent substance (A-4) in the form of fine powder having an average particle diameter of 320 nm. Fluorescent characteristics of the obtained fluorescent substance were measured by using a fluorescence spectrophotometer (F-7000, Hitachi High-Technologies Corporation, Japan). It was confirmed that the obtained fluorescent substance had an exciting-light peak wavelength of 438 nm, and an emission-light peak wavelength of 633 nm (red light).

1-5. Preparation of Visible Light-Excitable Oxide Fluorescent Substance (A-5)

By referring to "Journal of Luminescence, 2908-2912, 132 (2012)," a visible light-excitable oxide fluorescent substance $Ba_2SiO_4:Eu^{2+}$, having an exciting-light peak wavelength of 392 nm and a fluorescence peak wavelength of 616 nm, was synthesized.

The obtained fluorescent substance was coarsely crushed, and then manually milled by using a mortar made of a silicon nitride sintered product. The milled fluorescent substance was allowed to pass through a 30 μm sieves, thereby obtaining a visible light-excitable oxide fluorescent substance (A-5). A particle diameter distribution of the fluorescent substance was measured, and its average particle diameter was found to be 10 μm.

1-6. Preparation of Visible Light-Excitable Oxide Fluorescent Substance (A-6)

The visible light-excitable oxide fluorescent substance (A-5) was milled by using a fine crusher (LMZ015, Ashizawa Finetech Ltd., Japan) to obtain a visible light-excitable oxide fluorescent substance (A-6) in the form of fine powder having an average particle diameter of 290 nm. The obtained visible light-excitable oxide fluorescent substance was white in color. The fluorescent characteristics of the fluorescent substance were measured by using a fluorescence spectrophotometer (F-7000, Hitachi High-Technologies Corporation, Japan), and it was confirmed that its original fluorescent characteristics were not present.

1-7. Preparation of Visible Light-Excitable Nitride Fluorescent Substance (A-7)

The visible light-excitable nitride fluorescent substance (A-1) was milled by using a Fine crusher (LMZ015, Ashizawa Finetech Ltd., Japan) in the same manner as the visible light-excitable nitride fluorescent substance (A-2). However, in this experiment, a milling time was controlled to obtain a visible light-excitable nitride fluorescent substance (A-7) in the form of fine powder having an average particle diameter of 110 nm. Fluorescent characteristics of the obtained fluorescent substance were measured by using a fluorescence spectrophotometer (F-7000, Hitachi High-Technologies Corporation, Japan). It was confirmed that the fluorescent substance had an exciting-light peak wavelength of 445 nm and an emission light peak wavelength of 630 nm (red light).

1-8. Preparation of Visible Light-Excitable Nitride Fluorescent Substance (A-8)

The visible light-excitable nitride fluorescent substance (A-1) was milled by using a Fine crusher (LMZ015, Ashizawa Finetech Ltd., Japan) in the same manner as the visible light-excitable nitride fluorescent substance (A-2). However, in this experiment, a milling time was controlled to obtain a visible light-excitable nitride fluorescent substance (A-8) in the form of fine powder having an average particle diameter of 395 nm. Fluorescent characteristics of the obtained fluorescent substance were measured by using a fluorescence spectrophotometer (F-7000, Hitachi High-Technologies Corporation, Japan). It was confirmed that the obtained fluorescent substance had an exciting-light peak wavelength of 445 nm, and an emission light peak wavelength of 637 nm (red light).

1-9. Preparation of Visible Light-Excitable Nitride Fluorescent Substance (A-9)

The visible light-excitable nitride fluorescent substance (A-1) was milled by using a Fine crusher (LMZ015, Ashizawa Finetech Ltd., Japan) in the same manner as the visible light-excitable nitride fluorescent substance (A-2). The milling time was controlled to obtain a visible light-excitable nitride fluorescent substance (A-9) in the form of fine powder having an average particle diameter of 40 nm. The obtained visible light-excitable nitride fluorescent substance was white in color. The fluorescent characteristics of the fluorescent substance were measured by using a fluorescence spectrophotometer (F-7000, Hitachi High-Technologies Corporation, Japan), and it was confirmed that its original fluorescent characteristics were not shown.

1-10. Preparation of Visible Light-Excitable Nitride Fluorescent Substance (A-10)

The visible light-excitable nitride fluorescent substance (A-1) was milled by using a Fine crusher (LMZ015, Ashizawa Finetech Ltd., Japan) in the same manner as the visible light-excitable nitride fluorescent substance (A-2). The milling time was controlled to obtain a visible light-excitable nitride fluorescent substance (A-10) in the form of fine powder having an average particle diameter of 590 nm. Fluorescent characteristics of the obtained fluorescent substance were measured by using a fluorescence spectrophotometer (F-7000, Hitachi High-Technologies Corporation, Japan). It was confirmed that the fluorescent substance had an exciting-light peak wavelength of 445 nm and an emission light peak wavelength of 640 nm (red light).

2. Preparation of Crystalline Polyester Dispersion (B)

98 moles (mol) of dimethyl sebacate, 5 mol of dimethyl isophthalate, 2 mol of sodium sulfonate, 100 mol of ethylene glycol, and, based on 100 parts by weight of a total weight of these materials, 0.3 parts by weight of dibutyl tin oxide, which acts as a catalyst, were added to a three-neck flask which had been dried by heating. The air in the flask was purged with nitrogen gas by a pressure-reducing operation, thereby creating an inert atmosphere inside the flask. The resulting mixture was stirred and refluxed at a temperature of 180° C. for 5 hours while mechanical stirring. Then, under reduced pressure, the resulting mixture was stirred for 4 hours while the temperature was slowly raised to 230° C. When the reaction product became viscous, the reaction was stopped cooling with air, thereby producing a crystalline polyester (b). A weight average molecular weight (Mw) of the crystalline polyester (b) was measured by gel permeation chromatography (USA, Waters Corporation) (using polystyrene standards), and was found to be 30,000. A melting point (Tm) of the crystalline polyester (b) was measured by differential scanning calorimetry (EXSTAR DSC6220, Seiko Instruments Inc, Japan). As a result, a distinguishable endothermic peak was obtained at a temperature of 66° C.

A composition including 90 parts by weight of the crystalline polyester (b), 1.8 parts by weight of an ionic surfactant neogen RK (NeogenRK, Dai-ichi Kogyo Seiyaku Co., Ltd., Japan), and 210 parts by weight of ion exchanged water was heated to 100° C., and thoroughly dispersed by a subsequent use of a homogenizer (Japan, IKA Company, Ultra Turrax T-50), a high pressure gaulin homogenizer for 1 hour, thereby obtaining a crystalline polyester dispersion (B) having an average particle diameter of 130 nm and a solid content of 30 wt %.

3-1. Preparation of Non-Crystalline Polyester (Amorphous Polymer) Dispersion (C-1)

A reaction mixture containing 80 mole percent (mol %) of terephthalic acid, 20 mol % of isophthalic acid, 90 mol % of a bisphenol-A propylene oxide 2 mol adduct, and 10 mol % of ethylene glycol was loaded into a 5-liter flask equipped with a stirrer, a nitrogen-introduction tube, a thermometer, and a rectifying column. The reaction mixture was heated at 190° C. for 1 hour. After the heating ceased, 1.2 parts by weight of dibutyl tin oxide was added to the homogeneous mixture. While newly generated water was removed by distillation, the temperature of the reactant was raised from 190° C. to 240° C. for 6 hours. Subsequently, the dehydration condensation was performed at a temperature of 240° C. for 5 hours to obtain a non-crystalline polyester (C-1) having an acid value of 10.0 mgKOH/g and a weight average molecular weight of 8,500.

The obtained non-crystalline polyester (C-1) was melted and transferred into Cavitron CD-1010 (EUROTEC LIMITED, Japan), which is a dispersing machine, at a speed of 100 grams per minute (g/min). 0.37 wt % diluted aqueous ammonia solution prepared by diluting reagent ammonia in water by using ion exchanged water was loaded into a separate aqueous medium tank. The diluted ammonia in water was heated to a temperature of 120° C. by using a heat exchanger. The dilute ammonia in water was transferred to Cavitron CD-1010, together with a molten product of the non-crystalline polyester (C-1), at a speed of 0.1 liter per minute (l/min). Cavitron CD-1010 was operated in such a way that a rotator rotates at a rotation speed of 60 Hertz (Hz) under the pressure of 5 kilograms per square centimeter (kg/cm$^2$), thereby obtaining a non-crystalline polyester dispersion (C-1) having a solid content of 30 wt % in which the non-crystalline polyester (C-1) having an average particle diameter of 0.12 μm was dispersed.

3-2. Preparation of Non-Crystalline Polyester (Amorphous Polymer) Dispersion (C-2)

A reactant including 100 mol of terephthalic acid, 90 mol of a bisphenol-A ethylene oxide 2 mol adduct, and 10 mol of cyclohexane dimethanol was loaded into a 5-liter flask equipped with a stirrer, a nitrogen-introduction tube, a thermometer, and a rectifying column. The temperature of the reactant was raised to 190° C. over 1 hour. After it was confirmed that the reactant became homogeneous, 1.2 parts by weight of dibutyl tin oxide was added thereto. While newly generated water was removed by distillation, the temperature of the reactant was raised from 190° C. to 240° C. for 6 hours. Subsequently, the dehydration condensation was performed at a temperature of 240° C. for 3 hours to obtain a non-crystalline polyester (C-2) having an acid value of 9.0 mgKOH/g and a weight average molecular weight of 9,000.

The obtained non-crystalline polyester (C-2) was molten, and then, transferred into Cavitron CD-1010 at a speed of 100 grams per minute. 0.37 wt % dilute ammonia in water prepared by diluting reagent ammonia in water by using ion exchanged water was loaded into a separate aqueous medium tank. The dilute ammonia in water was heated to a temperature of 120° C. by using a heat exchanger. The dilute ammonia in water was transferred to Cavitron CD-1010, together with a molten product of the non-crystalline polyester (C-2), at a speed of 0.1 liters per minute. Cavitron CD-1010 was operated in such a way that a rotator rotates at a rotation speed of 60 Hz under the pressure of 5 kg/cm$^2$, thereby obtaining a non-crystalline polyester dispersion (C-2) having a solid content of 30 wt % in which the non-crystalline polyester (C-2) having an average particle diameter of 0.20 μm was dispersed.

4-1. Preparation of Colorant Dispersion (D-1)

A mixture including 45 parts by weight of magenta colorant (C.I. pigment red 122), 5 parts by weight of ionic surfactant NeogenRK (Dai-ichi Kogyo Seiyaku Co., Ltd., Japan), and 200 parts by weight of ion exchange water was dispersed by using a homogenizer (Japan, IKA Company, Ultra Turrax T-50) for 10 minutes to obtain a colorant dispersion (D-1) having an average particle diameter of 168 nm and a solid content of 23.0 wt %.

4-2. Preparation of Colorant Dispersion (D-2)

A colorant dispersion (D-2) was prepared in the same manner as the colorant dispersion (D-1), except that C.I. pigment red 269 was used as a magenta colorant.

4-3. Preparation of Colorant Dispersions (D-3) to (D-18)

Colorant dispersions (D-3) to (D-18) were prepared in the same manner the colorant dispersion (D-1), except that magenta colorants had corresponding compositions shown in Table 1.

The colorant dispersions (D-5), (D-7), (D-9) and (D-18) were in a non-homogeneous state in which a fluorescent substance colorant was precipitated and settled.

TABLE 1

| colorant | Fluorescent substance colorant (parts by weight) | | | | | | | | | | Pigment colorant (parts by weight) | |
|---|---|---|---|---|---|---|---|---|---|---|---|---|
| dispersion | A-1 | A-2 | A-3 | A-4 | A-5 | A-6 | A-7 | A-8 | A-9 | A-10 | PR122 | PR269 |
| D-1 | | | | | | | | | | | 45.0 | |
| D-2 | | | | | | | | | | | | 45.0 |
| D-3 | | | | | | | | | | | 22.5 | 22.5 |
| D-4 | | 22.5 | | | | | | | | | 22.5 | |
| D-5 | 22.5 | | | | | | | | | | 22.5 | |
| D-6 | | 22.5 | | | | | | | | | | 22.5 |
| D-7 | | | 22.5 | | | | | | | | | 22.5 |
| D-8 | | | | 22.5 | | | | | | | | 22.5 |
| D-9 | | | | | 22.5 | | | | | | | 22.5 |
| D-10 | | | | | | 22.5 | | | | | | 22.5 |
| D-11 | | 1.2 | | | | | | | | | | 43.8 |
| D-12 | | 4.5 | | | | | | | | | | 41.5 |
| D-13 | | 31.5 | | | | | | | | | | 13.5 |
| D-14 | | 36.0 | | | | | | | | | | 9.0 |
| D-15 | | | | | | | 22.5 | | | | 22.5 | |
| D-16 | | | | | | | | 22.5 | | | 22.5 | |
| D-17 | | | | | | | | | 22.5 | | 22.5 | |
| D-18 | | | | | | | | | | 22.5 | 22.5 | |

5. Preparation of Release Agent Dispersion (E)

45 parts by weight of Carnauba wax (melting point of 81° C.), 5 parts by weight of cationic surfactant Neogen R-K™ (Japan, Dai-ichi Kogyo Seiyaku Co., Ltd., NeogenRK), and 200 parts by weight of ion exchanged water were mixed and heated to 95° C.. The resulting mixture was then thoroughly dispersed by a subsequent use of a homogenizer (Japan, IKA Company, Ultra Turrax T-50) and a high pressure gaulin homogenizer to obtain a release agent dispersion (E) having an average particle diameter of 200 nm and a solid content of 20 wt %.

6. Preparation of Carrier (F)

13.5 parts by weight of toluene, 2.3 parts by weight of a methyl methacrylate/perfluorooctyl methacrylate copolymer (a polymerization ratio of 90/10, a weight average molecular weight of 49,000), 0.3 parts by weight of carbon black (VXC72, Cabot Corporation, USA), and 0.3 parts by weight of melamine polymer particles (EPOSTAR-S, Nippon Shokubai Corporation, Japan) were mixed and dispersed by using a sand mill for 1 hour to prepare a solution for forming a polymer coating layer. A mixture including the solution for forming a polymer coating layer and 100 parts by weight of Ferrite (a weight average particle diameter of 35 μm) was stirred at a temperature of 60° C. under reduced pressure for 20 minutes by using a vacuum degassing kneader to form a polymer coating layer on Ferrite, thereby obtaining a carrier (F).

Example 1

Preparation of Toner Base Particle 66.7 parts by weight of the crystalline polymer dispersion (B), 136.7 parts by weight of the non-crystalline polymer dispersion (C-1), 22.0 parts by weight of the colorant dispersion (D-4), and 50.0 parts by weight of the release agent dispersion (E) were loaded into a circular stainless flask and thoroughly mixed and dispersed by using a homogenizer (Japan, IKA Company, Ultra Turrax T-50). 0.20 parts by weight of polyaluminum chloride was added to the mixture, and the resultant was continuously dispersed by using a homogenizer. The mixture in the flask was heated with an oil bath to at a temperature of 48° C. while stirring. While the temperature of 48° C. was maintained for 60 minutes, 66.7 parts by weight of the non-crystalline polymer dispersion (C-2) was slowly added to the mixture. A 0.5 mol/l sodium hydroxide aqueous solution was subsequently added thereto to adjust a pH of the mixture to 9.0. The stainless flask was sealed. Then, the mixture in the flask was heated to a temperature of 96° C. while stirring with a magnetic stirrer. The temperature of the mixture was maintained at 96° C. for 5 hours.

Once the reaction was complete, the mixture was cooled, filtered, and thoroughly washed by using ion exchange water. The mixture was then subjected to the solid-liquid separation by using a Nutsche-type suction filter. The obtained solid content was re-dispersed and washed at a temperature of 40° C. in 1 liter (L) of ion exchanged water and stirred at a speed of 300 revolutions per minute (rpm) for 15 minutes. This solid-liquid separation and washing were repeatedly performed 5 times until a pH of the filtrate was 7.5 and an electric conductivity of the filtrate was 7.0 Siemens per centimeter (S/cm). The resultant was subjected to a solid-liquid separation by using a Nutsche-type suction filter and No. 5A filtering paper. The obtained solid content was vacuum dried for 12 hours to obtain toner base particles. A particle diameter of the toner base particle was measured by using Coulter-counter (Beckman Coulter Inc., USA). It was confirmed that a volume average particle diameter D50 was 5.9 μm, and that a particle diameter distribution coefficient GSD (geometric standard deviation) was 1.24.

Preparation of Externally Added Toner

Subsequently, an externally added toner was prepared as follows. 100 parts by weight of the toner base particle, 1.0 part by weight of Rutile type titanium oxide (a volume average particle diameter of 20 nm, treated with n-decyl trimethoxy silane), 2.0 parts by weight of silica (prepared by vapor oxidization, a volume average particle diameter of 40 nm, treated with silicon oil), and 0.5 parts by weight of a higher alcohol milling product (a volume average particle diameter of 8 μm)

were mixed by using a 5 liter Henschel mixer (NIPPON COKE & ENGINEERING CO., LTD, Japan) at a circumferential speed of 30 meters per second (m/s) for 15 minutes. Then, from the mixture, coarse particles were removed by using a 45 μm sieves, thereby completing the preparation of an externally added toner.

Preparation of Toner for Developing Electrostatic Latent Images 60 parts by weight of an externally added toner and 540 parts by weight of a carrier (F) were mixed by using a V mixer for 20 minutes. Then, the resulting mixture was screened by using a 212 μm sieves to prepare a magenta toner for developing electrostatic latent images.

Measurement of Chroma, Color Angle, and Visible Light Absorption Spectrum

Measurement was performed indoors at a temperature of 25° C. and in a relative humidity of 60%. First, from a main body, a magenta developer, and a magenta toner cartridge of Docu Centre Color 400CP, manufactured by US Xerox, previously existing magenta toner was thoroughly removed. The magenta toner cartridge was subsequently cleaned. The magenta toner cartridge was then filled with the magenta toner prepared as described above. The magenta developer and the magenta toner cartridge were mounted on the Docu Centre Color 400CP.

Then, a 3 centimeter (cm)×2 cm-size magenta 100% single color image was printed on an OK topcoat paper (OK Top Coat Paper, Oji Paper Co., Ltd., Japan) in a toner amount of 3.0 grams per square meter (g/m$^2$). A color space value (L*a*b*) and a visible-light absorption spectrum (a measurement wavelength range of about 400 nm to about 700 nm) of the obtained magenta single-color image were measured by using CM-3610A (Konica Minolta Inc., Japan). A reported color space value was an average value of values measured at 10 sites randomly selected in the magenta single-color image.

A color space value (L*a*b*), a magenta color space value ($L_{JC}$*$a_{JC}$*$b_{JC}$*) defined by "Japan Color 2007", and the following formulae were used to measure a brightness difference (ΔE), a chroma difference (ΔC*), and a hue difference (Δh). The calculation results are shown in Table 2.

$$\Delta E=(L^{*2}+a^{*2}+b^{*2})^{1/2}-(L_{JC}^{*2}+a_{JC}^{*2}+b_{JC}^{*2})^{1/2}$$

$$\Delta C^{*}=(a^{*2}+b^{*2})^{1/2}-(a_{JC}^{*2}+b_{JC}^{*2})^{1/2}$$

$$\Delta h=\tan^{-1}(b^{*}/a^{*})-\tan^{-1}(b_{JC}^{*}/a_{JC}^{*})$$

Color reproduction properties were evaluated based on these calculation results as follows.

Brightness: excellent (ΔE is 5 or more); good (ΔE is equal to or greater than 0 and less than 5); bad (ΔE is less than 0), Chroma: excellent (ΔC* is 5 or more); good (ΔC* is equal to or greater than 0 and less than 5); bad (ΔC* is less than 0), Hue: excellent (Δh is equal to or greater than −3° and equal to or less than 3°); bad (Δh is less than −3° or greater than 3°).

Examples 2-7

ΔE, ΔC* and Δh were obtained from the magenta toners which were prepared in the same manner as in Example 1 except that the colorant dispersions shown in Table 2 were used. Results thereof are shown in Table 2.

Comparative Examples 1-11

ΔE, ΔC* and Δh were obtained from the magenta toners which were prepared in the same manner as in Example 1 except that the colorant dispersions shown in Table 2 were used. Results thereof are shown in Table 2.

By using the obtained visible absorption spectra, absorption peak areas outside the range of 500 nm to 600 nm (e.g., absorption peak areas in 400 nm to 500 nm, and 600 nm to 700 nm) were calculated. Among the samples shown in Table 2, the magenta color of Comparative Example 3 is the closest to the magenta color defined by "Japan Color 2007." Accordingly, in Table 2, the absorption peak area is indicated as a ratio with respect to the absorption peak area of Comparative Example 3. FIG. 1 shows visible absorption spectra of Example 1, Comparative Example 1, and Comparative Example 3.

TABLE 2

| | Color dispersion | ΔE | ΔC* | Δh(°) | A ratio of visible absorption spectrum peak area with respect to Comparative Example 3 (%) |
|---|---|---|---|---|---|
| Example 1 | D-4 | 12.0 | 11.8 | −2.8 | 101.5 |
| Comparative Example 1 | D-1 | 8.7 | 9.1 | −11.9 | 82.6 |
| Comparative Example 2 | D-2 | 3.9 | 3.7 | 0.7 | 101.2 |
| Comparative Example 3 | D-3 | 3.4 | 3.4 | 0.1 | — |
| Comparative Example 4 | D-5 | Due to too large a particle diameter of fluorescent substance colorant, homogeneous toner base particles were not able to be obtained. The subsequent process and evaluation were stopped. | | | |
| Example 2 | D-6 | 8.7 | 7.6 | −1.9 | 98.5 |
| Comparative Example 5 | D-7 | Due to too large a particle diameter of fluorescent substance colorant, homogeneous toner base particles were not able to be obtained. The subsequent process and evaluation were stopped. | | | |
| Example 3 | D-8 | 6.2 | 5.5 | −1.3 | 99.1 |
| Comparative Example 6 | D-9 | Due to too large a particle diameter of fluorescent substance colorant, homogeneous toner base particles were not able to be obtained. The subsequent process and evaluation were stopped. | | | |
| Comparative Example 7 | D-10 | −9.9 | −9.8 | 1.3 | 100.8 |
| Comparative Example 8 | D-11 | 4.8 | 4.7 | 0.8 | 98.3 |
| Example 4 | D-12 | 5.6 | 5.3 | 1.6 | 101.5 |

TABLE 2-continued

| | Color dispersion | ΔE | ΔC* | Δh(°) | A ratio of visible absorption spectrum peak area with respect to Comparative Example 3 (%) |
|---|---|---|---|---|---|
| Example 5 | D-13 | 8.7 | 7.6 | −1.9 | 99.4 |
| Comparative Example 9 | D-14 | 15.2 | 13.5 | −12.4 | 92.6 |
| Example 6 | D-15 | 9.3 | 9.6 | −0.8 | 101.1 |
| Example 7 | D-16 | 14.3 | 10.5 | −1.8 | 100.7 |
| Comparative Example 10 | D-17 | −7.4 | −8.8 | 1.3 | 100.2 |
| Comparative Example 11 | D-18 | Due to too large a particle diameter of fluorescent substance colorant, homogeneous toner base particles were not able to be obtained. The subsequent process and evaluation were stopped. | | | |

As described above, according to the one or more of the above embodiments, the present disclosure provides a magenta toner having improved tone, chroma and electrophotographic properties.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims.

What is claimed is:

1. A magenta toner for developing electrostatic latent images, wherein the magenta toner comprises:

a magenta toner particle comprising a polymer binder and a colorant, wherein the colorant comprises a magenta pigment or dye and a visible light-excitable nitride fluorescent substance.

2. The magenta toner of claim 1, wherein the visible light-excitable nitride fluorescent substance has an average particle diameter of about 50 nanometers to about 500 nanometers.

3. The magenta toner of claim 1, wherein an amount of the visible light-excitable nitride fluorescent substance in the colorant is in a range of about 5 percent by weight to about 75 percent by weight based on 100 percent by weight of a total weight of the colorant.

4. The magenta toner of claim 1, wherein a host crystal for the visible light-excitable nitride fluorescent substance comprises at least one selected from $MAlSiN_3$, $M_2Si_5N_8$, and $MSi_2N_2O_2$, where M represents at least one selected from Mg, Ca, Sr, and Ba.

5. The magenta toner of claim 1, wherein an activator for the visible light-excitable nitride fluorescent substance comprises at least one selected from Eu, Cr, Mn, Fe, Bi, Ce, Pr, Nd, Sm, Tb, Dy, Ho, Er, Tm, and Yb.

6. The magenta toner of claim 1, wherein the visible light-excitable nitride fluorescent substance is CaAlSiN3:Eu, $SrAlSiN_3$:Eu, $(Ca_{1-a}Sr_a)AlSiN_3$:Eu, $CaAlSiN_3$:Ce, $SrAlSiN_3$:Ce, $(Ca_{1-a}Sr_a)AlSiN_3$:Ce, $Ca_2Si_5N_8$:Eu, $Sr_2Si_5N_8$:Eu, $Ba_2Si_5N_8$:Eu, $(Ca_{1-a}Sr_a)_2Si_5N_8$:Eu, $Ca_2Si_5N_8$:Ce, $Sr_2Si_5N_8$:Ce, $Ba_2Si_5N_8$:Ce, $(Ca_{1-a}Sr_a)_2Si_5N_8$:Ce, $CaSi_2N_2O_2$:Eu, $SrSi_2N_2O_2$:Eu, $BaSi_2N_2O_2$:Eu, $CaSi_2N_2O_2$:Ce, $SrSi_2N_2O_2$:Ce, $BaSi_2N_2O_2$:Ce, $Ba_3Si_6O_9N_4$:Eu, or a combination thereof, wherein $0 \leq a \leq 1$.

7. The magenta toner of claim 1, wherein the magenta toner particle further comprises a release agent.

* * * * *